US011686000B2

(12) United States Patent
Hellmers et al.

(10) Patent No.: US 11,686,000 B2
(45) Date of Patent: Jun. 27, 2023

(54) COMPOSITION AND METHOD FOR THE CHROMIUM-FREE PRETREATMENT OF ALUMINIUM SURFACES

(71) Applicant: Chemetall GmbH, Frankfurt (DE)

(72) Inventors: Heiko Hellmers, Frankfurt am Main (DE); Thomas Wendel, Frankfurt am Main (DE); Norbert Maurus, Frankfurt am Main (DE)

(73) Assignee: CHEMETALL GMBH, Frankfurt (DE)

( * ) Notice: Subject to any disclaimer, the term of this patent is extended or adjusted under 35 U.S.C. 154(b) by 976 days.

(21) Appl. No.: 16/463,196

(22) PCT Filed: Oct. 25, 2017

(86) PCT No.: PCT/EP2017/077308
§ 371 (c)(1),
(2) Date: May 22, 2019

(87) PCT Pub. No.: WO2018/095684
PCT Pub. Date: May 31, 2018

(65) Prior Publication Data

US 2020/0063267 A1 Feb. 27, 2020

(30) Foreign Application Priority Data

Nov. 23, 2016 (DE) ..... 102016223170.7

(51) Int. Cl.
*C23C 22/44* (2006.01)
*C23C 22/36* (2006.01)
*C22C 21/00* (2006.01)

(52) U.S. Cl.
CPC ..... *C23C 22/44* (2013.01); *C23C 22/361* (2013.01); *C22C 21/00* (2013.01)

(58) Field of Classification Search
None
See application file for complete search history.

(56) References Cited

U.S. PATENT DOCUMENTS

| | | | | |
|---|---|---|---|---|
| 5,919,318 | A | 7/1999 | Brands et al. | |
| 2003/0209289 | A1* | 11/2003 | Fristad | C23C 22/73 106/14.12 |
| 2007/0231496 | A1 | 10/2007 | Eriksson et al. | |
| 2009/0214883 | A1 | 8/2009 | De Zeeuw et al. | |
| 2012/0325110 | A1* | 12/2012 | Brouwer | C23C 22/78 106/1.22 |
| 2013/0142941 | A1* | 6/2013 | Damiani | C23C 22/83 427/8 |
| 2018/0237919 | A1 | 8/2018 | Maurus et al. | |

OTHER PUBLICATIONS

International Search Report for International Application No. PCT/EP2017/077308, dated Jan. 12, 2017, 2 pages.

* cited by examiner

*Primary Examiner* — Shamim Ahmed
*Assistant Examiner* — Bradford M Gates
(74) *Attorney, Agent, or Firm* — Armstrong Teasdale LLP

(57) ABSTRACT

Described herein is an aqueous, chromium-free composition for a pretreatment of aluminum surfaces, which includes at least one water-soluble phosphorus compound, at least one water-soluble zirconium compound, at least one water-soluble titanium compound, and at least one water-soluble molybdenum compound, a phosphorus compound content being in a range from 15 to 50 mg/l (calculated as phosphorus), a zirconium compound content being in a range from 400 to 600 mg/l (calculated as metal), a titanium compound content being in a range from 85 to 400 mg/l (calculated as metal), and a molybdenum compound content being in a range from 40 to 150 mg/l (calculated as metal). Also described herein are a corresponding method and a correspondingly pretreated component or strip.

20 Claims, No Drawings

COMPOSITION AND METHOD FOR THE CHROMIUM-FREE PRETREATMENT OF ALUMINIUM SURFACES

CROSS-REFERENCE TO RELATED APPLICATIONS

This application is a U.S. National Phase Application of PCT/EP2017/077308, filed Oct. 25, 2017, which claims the benefit of priority to German Patent Application No. 102016223170.7, filed Nov. 23, 2016, the entire contents of which are hereby incorporated by reference herein.

The present invention relates to a chromium-free composition for the pretreatment of aluminum surfaces, to a corresponding method, and also to a correspondingly pretreated component or strip.

The prior art does indeed disclose methods for pretreating aluminum surfaces that allow effective adhesive of coating material to aluminum surfaces. Oftentimes, however, they employ chromium-containing treatment solutions. Chromium is now undesirable as a constituent of treatment solutions, because of its toxicity and environmental harmfulness.

Although methods for the chromium-free pretreatment of aluminum surfaces are already known from the prior art, there are certain applications in which they have not so far led to satisfactory results in terms of coating adhesion, particularly if a wide variety of different aluminum alloys require the use of a single pretreatment solution.

It was an object of the present invention, therefore, to provide a chromium-free composition for pretreating aluminum surfaces, and also a corresponding method, that avoid the aforesaid disadvantages and in particular improve the adhesion of coating material to different aluminum surfaces, especially to alloys which represent variations of the series 1000—including soft-annealed—, 2000, 4000, and 5000, and also of the series 8000 in accordance with DIN EN 573-3.

This object is achieved by a composition according to claim 1, a concentrate according to claim 9, a method according to claim 10, and a component or strip according to claim 14.

The dependent claims show advantageous embodiments of the present invention.

For the purposes of the present invention, "aqueous" means that more than 50 wt % of the solvent present is water.

"Chromium-free composition" means that it is prepared using only raw materials containing chromium at most as an impurity in the ppm range.

By an "aluminum surface" is meant a surface consisting at least partly of aluminum or one aluminum alloy.

The term "hexafluorozirconic acid" is intended to encompass not only hexafluorozirconic acid itself but also its singly and doubly deprotonated forms. Similar comments apply in respect of "hexafluorotitanic acid".

The term "phosphate" is intended to encompass not only orthophosphate but also pyrophosphate, polyphosphate, and also, respectively, all singly or multiply protonated forms. The term "molydate" is intended to encompass not only molybdate itself but also its singly or doubly protonated form.

The term "organic polymer" is also intended to include organic copolymers and also mixtures of organic polymers and/or copolymers.

A subject of the present invention is an aqueous, chromium-free composition for the pretreatment of aluminum surfaces, which comprises at least one water-soluble phosphorus compound, at least one water-soluble zirconium compound, at least one water-soluble titanium compound, and at least one water-soluble molybdenum compound, the phosphorus compound content being in the range from 15 to 50 mg/l (calculated as phosphorus), the zirconium compound content being in the range from 400 to 600 mg/l (calculated as metal), the titanium compound content being in the range from 85 to 400 mg/l (calculated as metal), and the molybdenum compound content being in the range from 40 to 150 mg/l (calculated as metal).

Preferably here the phosphorus compound content is in the range from 25 to 40 mg/l (calculated as phosphorus), the zirconium compound content is in the range from 450 to 540 mg/l (calculated as metal), the titanium compound content is in the range from 200 to 400 mg/l (calculated as metal), and the molybdenum compound content is in the range from 60 to 130 mg/l (calculated as metal).

More preferably here the phosphorus compound content is in the range from 30 to 38 mg/l (calculated as phosphorus), the zirconium compound content is in the range from 470 to 520 mg/l (calculated as metal), the titanium compound content is in the range from 350 to 380 mg/l (calculated as metal), and the molybdenum compound content is in the range from 80 to 125 mg/l (calculated as metal).

The intention, however, is explicitly to encompass all subsidiary combinations of the aforesaid ranges, preferred ranges, and more preferred ranges for the individual contents as well: for example, the combination of the phosphorus compound content in the range from 15 to 50 mg/l, of the preferred zirconium compound content in the range from 450 to 540 mg/l, of the more preferred titanium compound content in the range from 350 to 380 mg/l, and of the molybdenum compound content in the range from 40 to 150 mg/l.

Preferably the ratios of the individual phosphorus compound, zirconium compound, titanium compound, and molybdenum compound contents are in the range of (0.04 to 0.40):(1.4 to 5.8):1.0:(0.10 to 1.4), preferably in the range from (0.06 to 0.25):(1.4 to 3.5):1.0:(0.15 to 0.9), and more preferably in the range of (0.08 to 0.12):(1.4 to 1.5):1.0:(0.20 to 0.40) (standardized to the titanium compound content).

Here as well, the intention is to encompass explicitly all subsidiary combinations of the aforesaid preferred, more preferred, and very preferred ranges for the individual ratios: for example, the combination (0.04 to 0.40):(1.4 to 3.5):1.0:(0.20 to 0.40).

The aqueous composition preferably comprises free fluoride, the free fluoride content being in the range from 40 to 100 mg/l, preferably in the range from 60 to 80 mg/l, and the total fluorine content being in the range from 1 to 2 g/l, preferably in the range from 1.4 to 1.8 g/l.

The free fluoride content here is determined potentiometrically using a fluoride-sensitive electrode at room temperature; the total fluorine content is determined distillatively by the method of Seel and also potentiometrically.

Preferably the at least one zirconium compound here comprises hexafluorozirconic acid and the at least one titanium compound comprises hexafluorotitanic acid. More preferably here the at least one zirconium compound is hexafluorozirconic acid and the at least one titanium compound is hexafluorotitanic acid.

The at least one phosphorus compound preferably comprises phosphate. The at least one molybdenum compound preferably comprises molybdate. More preferably the at least one phosphorus compound is phosphate and the at least one molybdenum compound is molybdate.

According to one preferred embodiment, the at least one zirconium compound is hexafluorozirconic acid, the at least one titanium compound is hexafluorotitanic acid, the at least one phosphorus compound is phosphate, and the at least one molybdenum compound is molybdate.

The aqueous composition preferably has a pH (at room temperature) in the range from 2.0 to 5.0, more preferably in the range from 3.0 to 4.0. Further, the aqueous composition preferably has free acid points in the range from 3.9 to 4.5 and total acid points of not more than 25.

According to one preferred embodiment, the aqueous composition has a pH (at room temperature) in the range from 3.0 to 4.0, free acid points in the range from 3.9 to 4.5, and total acid points of not more than 25.

To determine the free acid points, 25 ml of the aqueous composition are diluted with 100 ml of distilled water in a suitable vessel and admixed with around 5 ml of a 25% strength potassium fluoride solution and also 5 drops of a phenolphthalein solution. Titration is then carried out with 0.1 M aqueous sodium hydroxide solution until a color change to red, in other words to a pH of 8.6. The volume in ml of the aqueous sodium hydroxide solution consumed in the titration gives the free acid points accordingly.

Conversely, for determining the total acid points, 25 ml of the aqueous composition are diluted with 100 ml of distilled water in a suitable vessel and admixed with 5 drops of a phenolphthalein solution. Titration is then carried out with 0.1 M aqueous sodium hydroxide solution until a color change to red, in other words to a pH of 8.6. The volume in ml of the aqueous sodium hydroxide solution consumed in the titration gives the total acid points accordingly.

The aqueous composition preferably comprises in total not more than 1 mg/l, more preferably not more than 0.5 mg/l, and very preferably not more than 0.1 mg/l of organic polymer. The reason is that the presence of organic polymers, particularly of polyacrylic acid, may have adverse consequences for the coating adhesion achieved.

The aqueous composition preferably comprises not more than 300 mg/l, more preferably not more than 100 mg/l, of aluminum. Aluminum is not added during the preparation of the aqueous composition, but enters the latter via the chemical reaction between treatment solution and the aluminum surface being treated.

The aqueous composition preferably comprises in total not more than 20 mg/l, more preferably not more than 10 mg/l, of the elements As, Ba, Cd, Co, Cu, Mn, Ni, Pb, Sb, Sn, Sr, V, and Ce.

The present invention pertains, moreover, to a concentrate wherefrom by dilution with water and optional adjustment of the pH with a suitable acid or base, an aqueous composition of the invention is obtainable.

Another subject of the present invention is a method for chromium-free pretreatment of aluminum surfaces, which comprises contacting an optionally cleaned and rinsed surface consisting at least partly of aluminum or an aluminum alloy with the aqueous composition of the invention and then optionally carrying out rinsing and/or drying.

Said surface comprises in particular the surface of a component or of a strip.

The surface preferably consists predominantly, more preferably exclusively or nearly exclusively, of aluminum or at least one aluminum alloy.

Suitable aluminum alloys are, in particular, aluminum-magnesium alloys such as those of the 5000 series and aluminum-magnesium-silicon alloys such as those of the 2000 series.

Contacting of the surface with the composition of the invention may be accomplished by immersive application and also by spray application.

In the case both of immersive application and of spray application, the surface is contacted with the composition of the invention preferably for 4 to 10 seconds at 45 to 60° C., more preferably for 5 to 7 seconds at 50 to 55° C.

Preferably the surface is contacted with the aqueous treatment solution such as to result in a phosphorus addon (calculated as $P_2O_5$) in the range from 8 to 17 mg/m$^2$, preferably in the range from 10 to 15 mg/m$^2$, a zirconium addon in the range from 1 to 6 mg/m$^2$, preferably in the range from 1 to 2 mg/m$^2$, a titanium addon in the range from 7 to 19 mg/m$^2$, preferably in the range from 11 to 16 mg/m$^2$, and a molybdenum addon in the range from 6 to 18 mg/m$^2$, preferably in the range from 9 to 14 mg/m$^2$, on the surface. The addons here are determined by means of x-ray fluorescence (XRF) analysis.

According to one preferred embodiment, the surface is the surface of a strip, and the surface is immersed in the aqueous composition for 5 to 10 seconds at 50 to 55° C.

Advantageously the surface is first of all cleaned alkalinically or alkalinically and acidically, then rinsed thoroughly with water, preferably in a plurality of stages, and immersed in the aqueous composition.

The present invention pertains, furthermore, to a component or strip having a surface consisting at least partly of aluminum or an aluminum alloy, the component or strip being attainable with the method of the invention and optionally having been coated.

The surface of the component or strip in this case preferably has a phosphorus addon (calculated as $P_2O_5$) in the range from 8 to 17 mg/m$^2$, preferably in the range from 10 to 15 mg/m$^2$, a zirconium addon in the range from 1 to 6 mg/m$^2$, preferably in the range from 1 to 2 mg/m$^2$, a titanium addon in the range from 7 to 19 mg/m$^2$, preferably in the range from 11 to 16 mg/m$^2$, and a molybdenum addon in the range from 6 to 18 mg/m$^2$, preferably in the range from 9 to 14 mg/m$^2$.

In the case of coating systems based on a polyester-melamine resin combination, in particular, an improvement in coating adhesion can be achieved with the present invention.

The present invention is illustrated below using inventive and comparative examples. There is no intention that these examples should in any way limit the subject matter of the present invention, however.

EXAMPLES

The inventive compositions IE1 to IE6 and also the noninventive compositions CE1 to CE4, as apparent from tab. 1, were produced as follows:

First of all, an aqueous, acidic solution of a phosphorus compound was prepared. Solid ammonium heptamolybdate was added to this solution and dissolved. Next, the solution was rounded out with zirconium fluoride and titanium fluoride compounds, likewise present in aqueous solution.

TABLE 1

| | X compound content in mg/l | | | |
|---|---|---|---|---|
| (Comp.) Ex. | X = P | Zr | Ti | Mo |
| IE1 | 35 | 513 | 356 | 81 |
| IE2 | 35 | 513 | 356 | 122 |

TABLE 1-continued

| (Comp.) Ex. | X compound content in mg/l | | | |
|---|---|---|---|---|
| | X = P | Zr | Ti | Mo |
| IE3 | 20 | 513 | 173 | 41 |
| IE4 | 17 | 513 | 356 | 91 |
| IE5 | 35 | 513 | 89 | 122 |
| IE6 | 35 | 513 | 167 | 81 |
| CE1 | 0 | 513 | 176 | 122 |
| CE2 | 35 | 513 | 0 | 41 |
| CE3 | 0 | 513 | 0 | 82 |

Subsequently in each case an aluminum sheet cleaned alkalinically beforehand was immersed for 5 seconds at 50° C. in the corresponding composition, and was rinsed and dried.

The addons of phosphorus (as $P_2O_5$), zirconium, titanium, and molybdenum were each determined by X-ray fluorescence (XRF) analysis (see tab. 2).

The sheets were subsequently coated with a polyamino resin combination, using a 30 μm doctor blade. The coating material was then baked in an oven at 250° C. (max. temperature of sheets: 224° C.) for 45 seconds, to give a coating film thickness of 7 μm.

In order to determine the coating adhesion on the respective aluminum sheet, two tests were conducted: a DIN EN 13523-7 T-bend test and a DIN EN ISO 2409 cross-cut test. These tests furnished the coating delamination values evident from tab. 2. The lower the value in question, the better the coating adhesion.

TABLE 2

| (Comp.) Ex. | Addon of X in mg/m² | | | | Coating delamination in test Y in % | |
|---|---|---|---|---|---|---|
| | X = $P_2O_5$ | Zr | Ti | Mo | Y = T-bend test | Y = cross-cut test |
| IE1 | 14-15 | 2 | 15-16 | 13-14 | 2 | 0 |
| IE2 | 11-14 | 2 | 11-13 | 11-13 | 2 | 0 |
| IE3 | 11 | 5-6 | 11-12 | 8 | 2 | 2.5 |
| IE4 | 11-12 | 4 | 18-19 | 10-11 | 8 | 0 |
| IE5 | 12-15 | 4-5 | 8-10 | 13-14 | 9 | 0 |
| IE6 | 16-17 | 2 | 13-14 | 17-18 | 7 | 2.5 |
| CE1 | <2 | 14-16 | 22-25 | 25-30 | 30 | 47.5 |
| CE2 | 8-11 | 7-10 | 2 | 6-10 | 25 | 50 |
| CE3 | <2 | 22-27 | 2 | 16-25 | 51 | 82.5 |

The significantly lower coating delamination (improved coating adhesion) in the case of the inventive compositions IE1 to IE6 by comparison with the noninventive compositions CE1 to CE3 in both the T-bend test and the cross-cut test is clearly apparent. The best results here are furnished by IE1 and IE2.

What is claimed is:

1. An aqueous, chromium-free composition for a pretreatment of aluminum surfaces, which comprises at least one water-soluble phosphorus compound, at least one water-soluble zirconium compound, at least one water-soluble titanium compound, and at least one water-soluble molybdenum compound, a phosphorus compound content being in a range from 25 to 40 mg/l calculated as phosphorus, a zirconium compound content being in a range from 400 to 600 mg/l calculated as metal, a titanium compound content being in a range from 200 to 400 mg/l calculated as metal, and a molybdenum compound content being in a range from 40 to 150 mg/l calculated as metal, the aqueous composition having a pH at room temperature in a range from 2.0 to 5.0.

2. The aqueous composition according to claim 1, wherein the zirconium compound content is in a range from 450 to 540 mg/l calculated as metal, and the molybdenum compound content is in a range from 60 to 130 mg/l calculated as metal.

3. The aqueous composition according to claim 1, wherein a ratio of the individual phosphorus compound, zirconium compound, titanium compound, and molybdenum compound contents is in a range of (0.04 to 0.40):(1.4 to 5.8):1.0:(0.10 to 1.4) standardized to the titanium compound content.

4. The aqueous composition according to claim 1, further comprising free fluoride, wherein a free fluoride content is in a range from 40 to 100 mg/l, a total fluorine content is in a range from 1 to 2 g/l, the at least one zirconium compound comprises hexafluorozirconium acid, and the at least one titanium compound comprises hexafluorotitanic acid.

5. The aqueous composition according to claim 1, wherein the aqueous composition has a pH in a range from 3.0 to 4.0, free acid points in a range from 3.9 to 4.5, and total acid points of not more than 25.

6. The aqueous composition according to claim 1, which comprises in total not more than 1 mg/l of organic polymer.

7. The aqueous composition according to claim 1, which comprises not more than 300 mg/l of aluminum.

8. The aqueous composition according to claim 1, which comprises in total not more than 20 mg/l of elements selected from the group consisting of As, Ba, Cd, Co, Cu, Mn, Ni, Pb, Sb, Sn, Sr, V, and Ce.

9. The aqueous composition according to claim 1, wherein the phosphorus compound content is in a range from 30 to 38 mg/l calculated as phosphorus, the zirconium compound content is in a range from 470 to 520 mg/l calculated as metal, the titanium compound content is in a range from 350 to 380 mg/l calculated as metal, and the molybdenum compound content is in a range from 80 to 125 mg/l calculated as metal.

10. The aqueous composition according to claim 1, wherein a ratio of the individual phosphorus compound, zirconium compound, titanium compound, and molybdenum compound contents is in a range of (0.06 to 0.25):(1.4 to 3.5):1.0:(0.15 to 0.9) standardized to the titanium compound content.

11. The aqueous composition according to claim 1, which comprises in total not more than 0.5 mg/l of organic polymer.

12. A concentrate wherefrom by dilution with a suitable solvent and optionally adjustment of a pH with a suitable acid or base, an aqueous composition according to claim 1 is obtainable.

13. A method for a substantially chromium-free pretreatment of aluminum surfaces, which comprises contacting an optionally cleaned and rinsed surface consisting at least partly of aluminum or an aluminum alloy with an aqueous composition according to claim 1 and then optionally carrying out rinsing and/or drying.

14. The method according to claim 13, wherein the surface is contacted with the aqueous composition such as to result in a phosphorus addon calculated as $P_2O_5$ in a range from 8 to 17 mg/m², a zirconium addon in a range from 1 to 6 mg/m², a titanium addon in a range from 7 to 19 mg/m², and a molybdenum addon in a range from 6 to 18 mg/m², on the surface.

15. The method according to claim 13, wherein the surface is a surface of a strip and the surface is immersed in the aqueous composition for 5 to 10 seconds at 50 to 55° C.

16. The method according to claim 13, wherein the surface is first of all cleaned alkalinically or alkalinically and acidically, then thoroughly rinsed with water, and immersed in the aqueous composition.

17. A component or strip with a surface consisting at least partly of aluminum or an aluminum alloy, which is obtainable with a method according to claim 13 and optionally has been coated.

18. The component or strip according to claim 17, wherein its surface has a phosphorus addon calculated as $P_2O_5$ in a range from 8 to 17 $mg/m^2$, a zirconium addon in a range from 1 to 6 $mg/m^2$, a titanium addon in a range from 7 to 19 $mg/m^2$, and a molybdenum addon in a range from 6 to 18 $mg/m^2$.

19. The method according to claim 13, wherein the surface is first of all cleaned alkalinically or alkalinically and acidically, then thoroughly rinsed with water in a plurality of stages, and immersed in the aqueous composition.

20. A concentrate wherefrom by dilution with water and optionally adjustment of a pH with a suitable acid or base, an aqueous composition according to claim 1 is obtainable.

* * * * *